US010060698B2

(12) United States Patent
Mehki

(10) Patent No.: US 10,060,698 B2
(45) Date of Patent: Aug. 28, 2018

(54) SELF-DEFENSE DEVICE

(71) Applicant: Larry Mehki, Monroe, MI (US)

(72) Inventor: Larry Mehki, Monroe, MI (US)

(73) Assignee: Larry Mehki, Monroe, MI (US)

( * ) Notice: Subject to any disclaimer, the term of this patent is extended or adjusted under 35 U.S.C. 154(b) by 0 days.

(21) Appl. No.: 15/458,372

(22) Filed: Mar. 14, 2017

(65) Prior Publication Data

US 2017/0261285 A1 Sep. 14, 2017

Related U.S. Application Data

(60) Provisional application No. 62/389,955, filed on Mar. 14, 2016.

(51) Int. Cl.

| | |
|---|---|
| ***F41C 9/02*** | (2006.01) |
| ***F41G 1/35*** | (2006.01) |
| ***F41A 3/58*** | (2006.01) |
| ***F41A 19/41*** | (2006.01) |
| ***F41A 9/28*** | (2006.01) |
| *G08B 5/36* | (2006.01) |

(52) U.S. Cl.

CPC ..... *F41C 9/02* (2013.01); *F41A 3/58* (2013.01); *F41A 9/28* (2013.01); *F41A 19/41* (2013.01); *F41G 1/35* (2013.01); *G08B 5/36* (2013.01)

(58) Field of Classification Search

CPC ..... F41C 9/04; F41C 9/02; F41C 9/00
USPC ..... 42/1.09, 146, 1.16; 362/110, 114
See application file for complete search history.

(56) References Cited

U.S. PATENT DOCUMENTS

| | | | | |
|---|---|---|---|---|
| 1,461,600 | A * | 7/1923 | Cottrell | F41C 9/00 362/114 |
| 2,625,764 | A * | 1/1953 | O'Brien | F21V 33/00 362/102 |
| 4,153,927 | A * | 5/1979 | Owens | B43L 3/00 362/110 |
| 6,823,621 | B2 * | 11/2004 | Gotfried | F41A 17/066 42/70.01 |
| 7,896,518 | B2 * | 3/2011 | Holmes | F21L 4/027 362/184 |
| 8,739,447 | B2 * | 6/2014 | Merritt | F41G 11/004 362/110 |
| 9,062,930 | B1 * | 6/2015 | Burke | F41C 9/00 |
| 2004/0090775 | A1 * | 5/2004 | Hsien | F21L 4/025 362/184 |
| 2015/0308670 | A1 * | 10/2015 | Moore | F21V 23/04 362/114 |

* cited by examiner

*Primary Examiner* — Reginald S Tillman, Jr.

(57) ABSTRACT

A self-defense device with a body, a gun barrel, a trigger assembly, at least one forward light, and a switch is disclosed. The body is held by a human hand. The gun barrel can be positioned in the body and include an entry port and an exit port. The trigger assembly includes a trigger and a firing pin. The firing pin is moveable to engage a round in the barrel. The light can be exposed on an outer surface of the body. The light is positioned such that light emitted by the light projects forward, along the axis of the barrel. The switch can selectively activate and deactivate the light. The switch and the trigger are positioned close to one another so as to be concurrently engageable by a single human hand.

18 Claims, 12 Drawing Sheets

SELF-DEFENSE DEVICE

CROSS-REFERENCE TO RELATED APPLICATIONS

This application claims the benefit of U.S. Provisional Patent Application Ser. No. 62/389,955 for a DEFENDER, filed on Mar. 14, 2016, which is hereby incorporated by reference in its entirety.

BACKGROUND

1. Field

The present disclosure relates to devices used for self-defense.

2. Description of Related Prior Art

Law enforcement officers often encounter suspects under poor lighting conditions. Hand-held flashlights can be used to illuminate a suspect that the officer is questioning. The officer may keep his weapon holstered during the interaction with the suspect to prevent the suspect from becoming agitated. However, the safety of the officer may compromised by not having his weapon in hand.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A self-defense device can include a body, a gun barrel, a trigger assembly, at least one forward light, and a switch. The body can be graspable and suspendable by human hand. The gun barrel can be at least partially housed in the body and can extend along a longitudinal axis between an entry port and an exit port. The exit port is not enclosed by the body. The trigger assembly can include a trigger and a firing pin. The trigger assembly can be at least partially housed in the body proximate to the gun barrel such that the firing pin is selectively moveable to engage a round positioned at the entry port. The at least one forward light can be at least partially housed in the body and exposed on an outer surface of the body. The at least one forward light is positioned such that light emitted by the at least one forward light projects along the longitudinal axis. The switch can be configured to selectively activate and deactivate the at least one forward light. The switch is at least partially housed in the body and exposed on the outer surface of the body. The switch and the trigger are positioned close to one another so as to be concurrently engageable by a single human hand.

BRIEF DESCRIPTION OF THE DRAWINGS

The detailed description set forth below references the following drawings.

DETAILED DESCRIPTION

Figure 1:
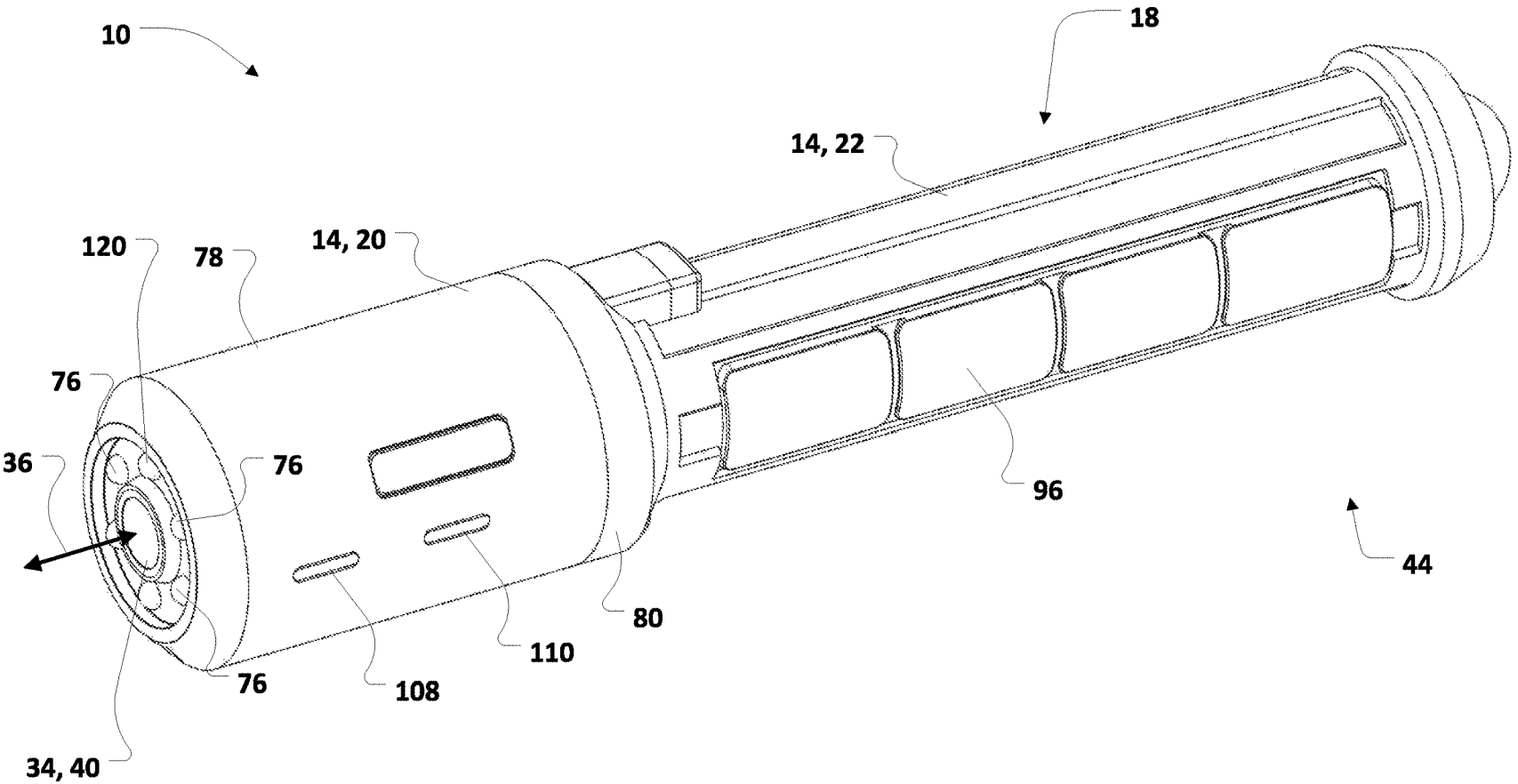
FIG. 1 is a perspective view of a self-defense device in the operating configuration according to an exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure, as demonstrated by the exemplary embodiments described below, can provide a self-defense device that can be utilized by a law enforcement officer, for example. The law enforcement officer can use the self-defense device when investigating a crime scene or when interacting with a driver of a vehicle that has been pulled-over. The self-defense device can provide light as well as the capacity to fire at least one round of ammunition in self-defense.

A self-defense device 10 according to an exemplary embodiment of the present disclosure is illustrated in FIGS. 1-11. The exemplary self-defense device 10 includes a body 12. The exemplary body 12 includes an outer surface 14. The exemplary body 12 includes a forward portion 16 and an aft portion 18. The exemplary outer surface includes a surface area 20 defined by the forward portion 16 and a surface area 22 defined by the aft portion 18.

Figure 2:
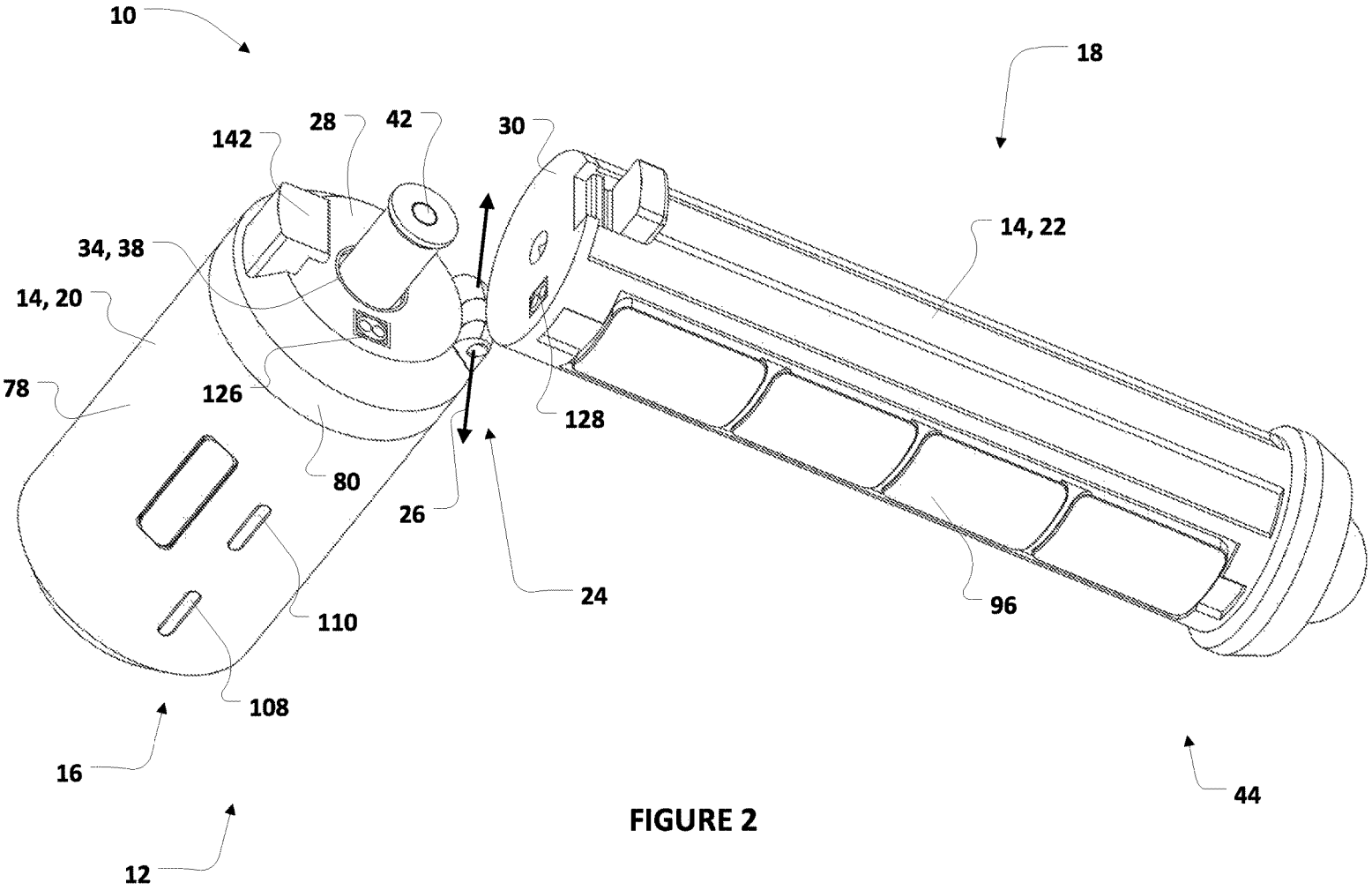
FIG. 2 is a perspective view of the self-defense device in the loading configuration according to an exemplary embodiment of the present disclosure.
Figure 3:
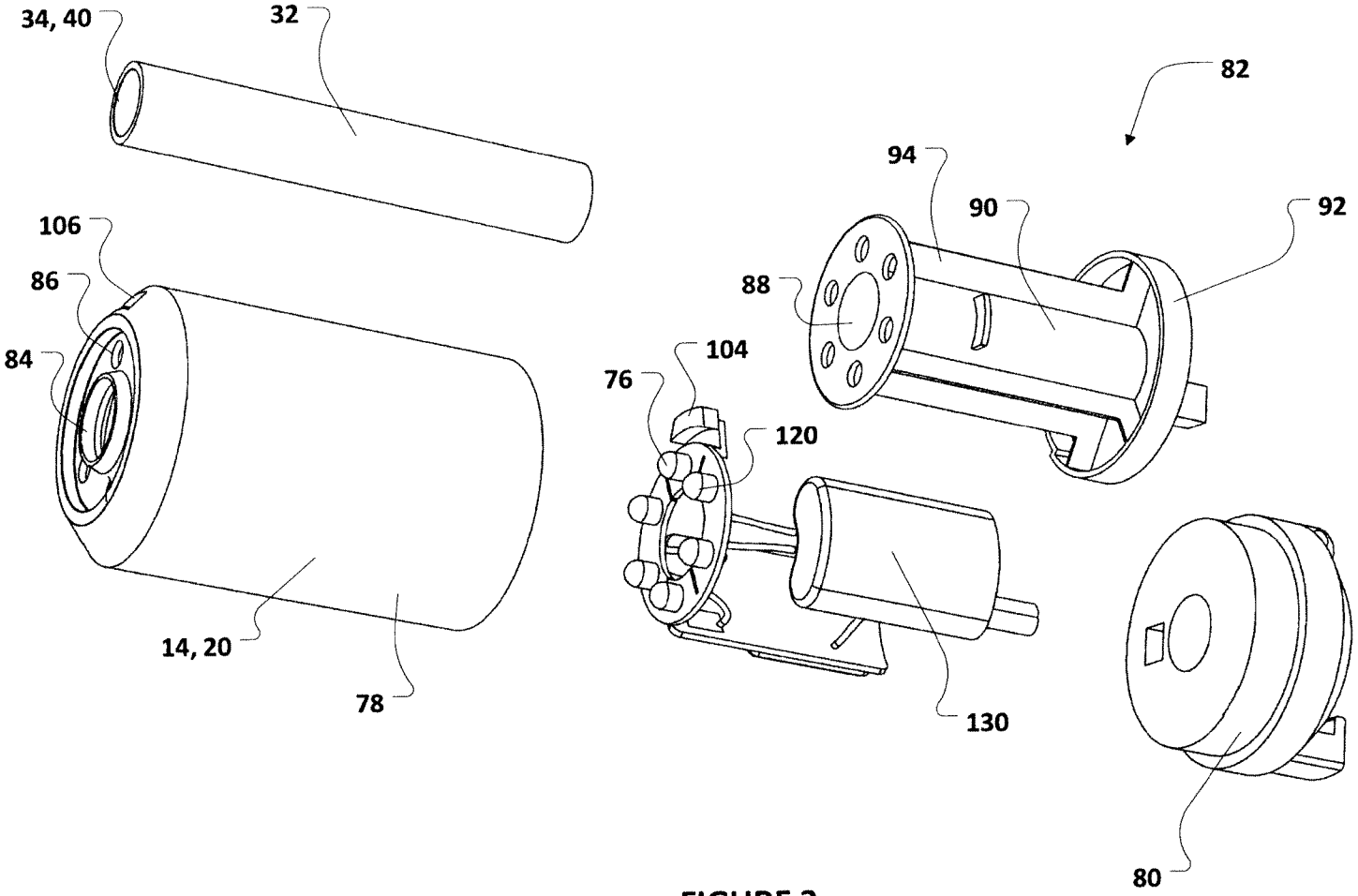
FIG. 3 is a first exploded view of a forward portion of the self-defense device.
Figure 4:
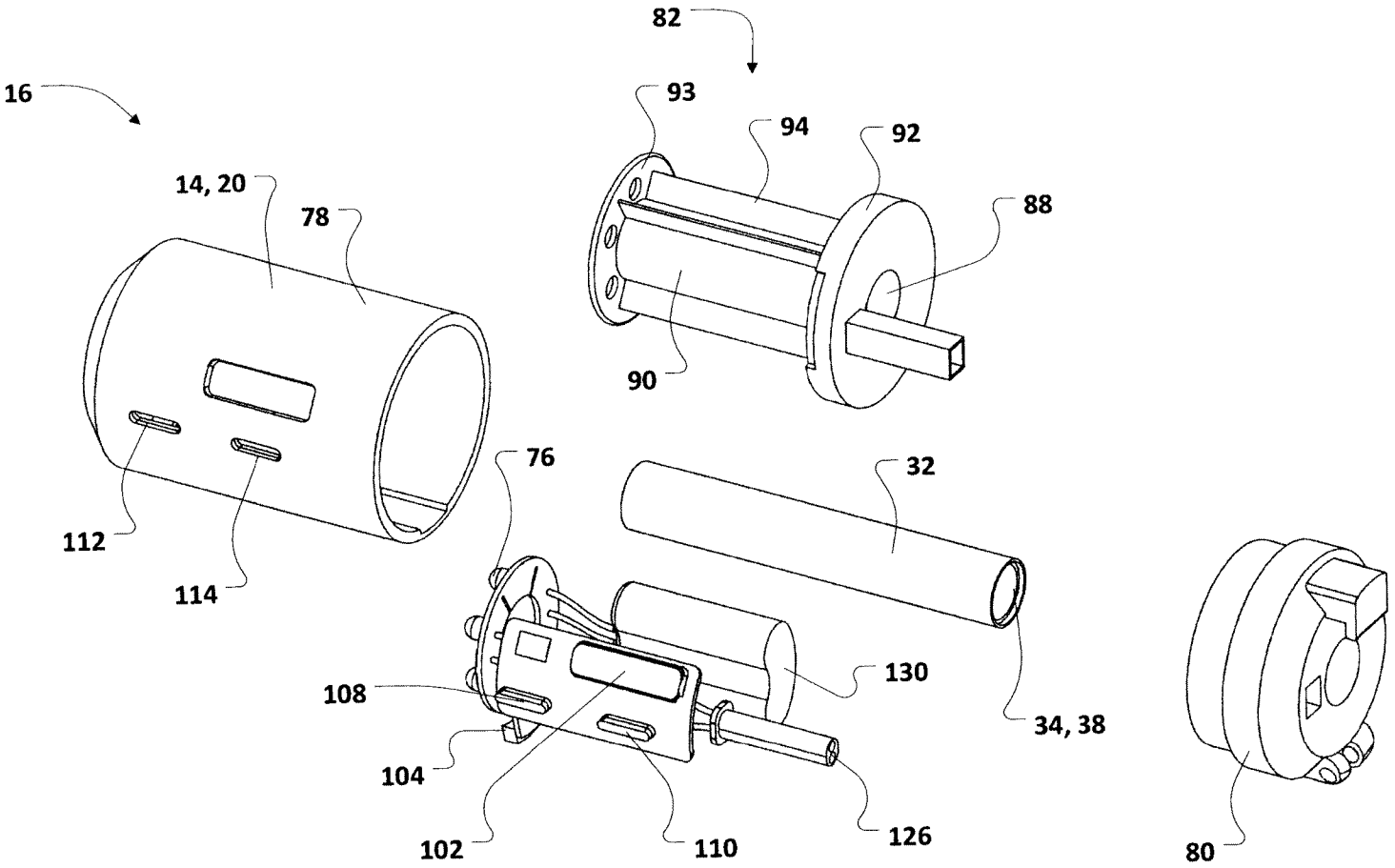
FIG. 4 is a second exploded view of the forward portion of the self-defense device.
Figure 5:
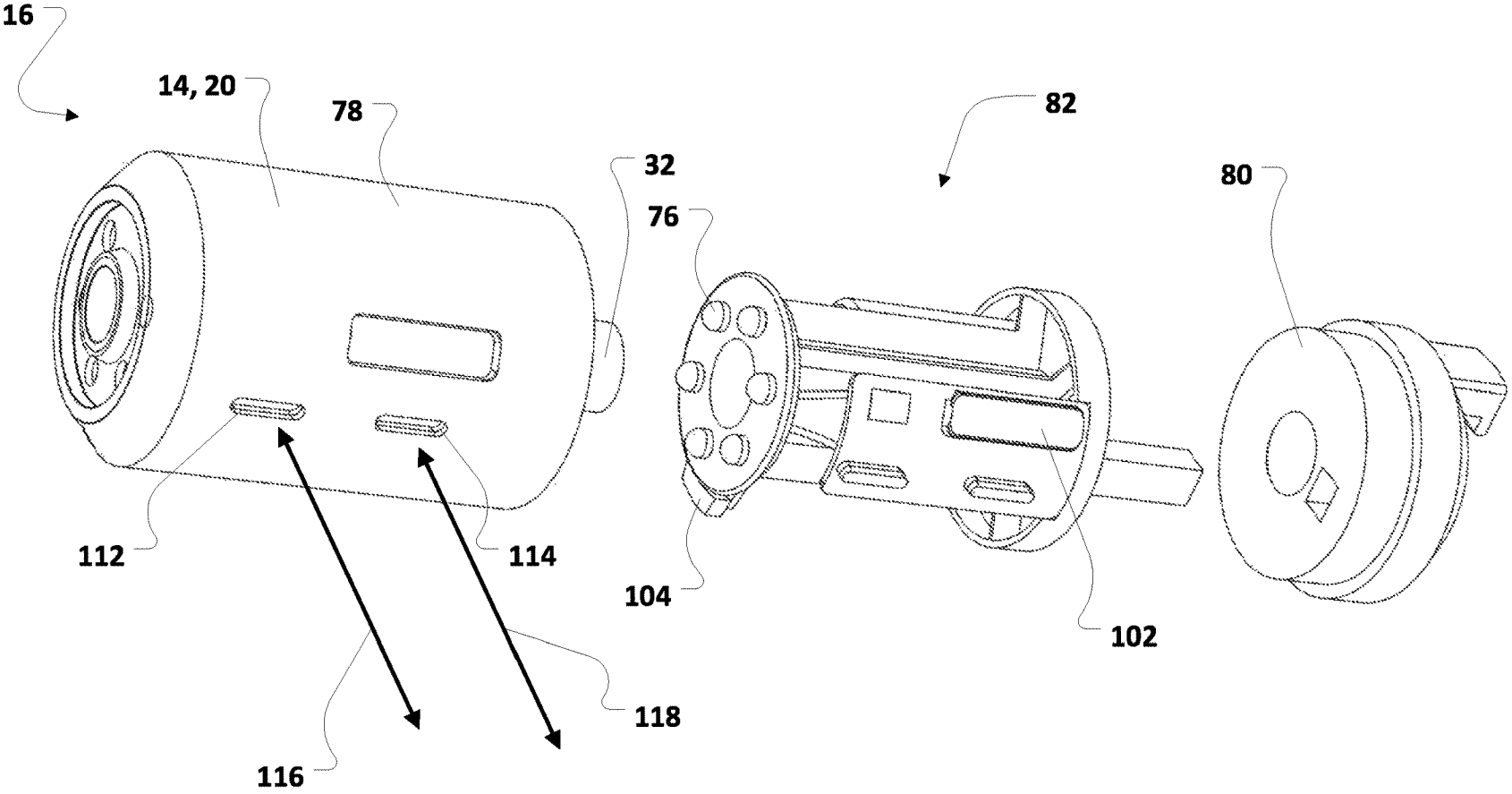
FIG. 5 is a third exploded view of the forward portion of the self-defense device.
Figure 6:
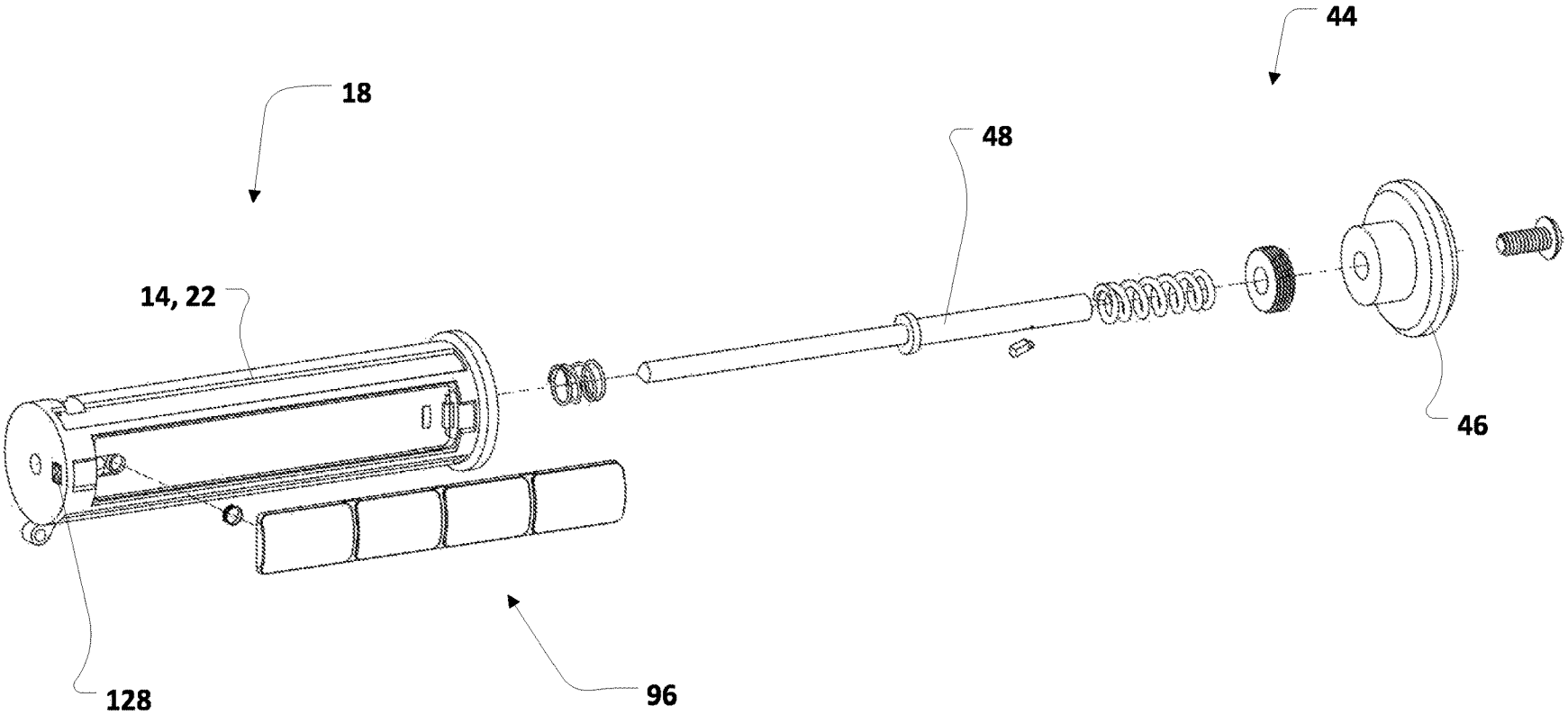
FIG. 6 is a first exploded view of an aft portion of the self-defense device.
Figure 7:
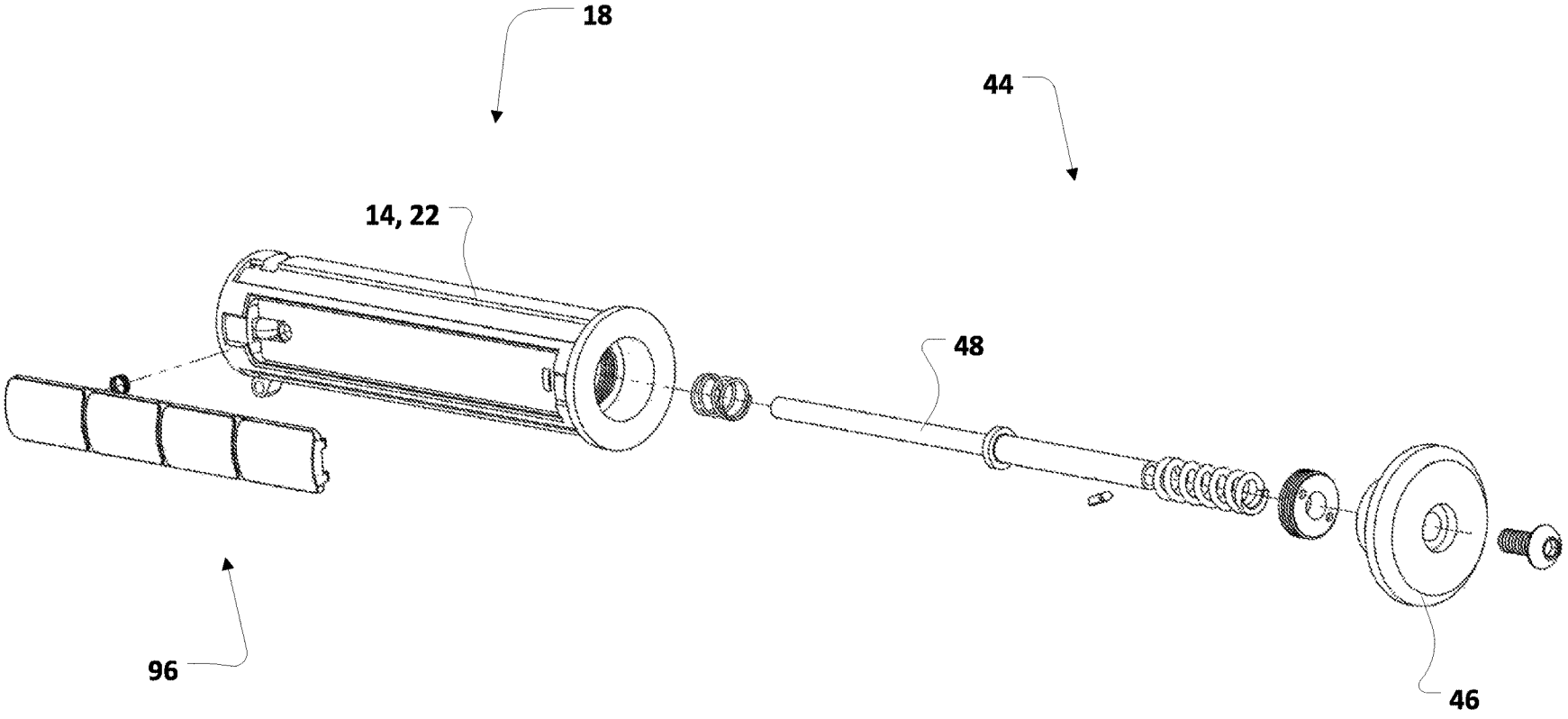
FIG. 7 is a second exploded view of the aft portion of the self-defense device.

The exemplary forward portion 16 and exemplary aft portion 18 are releasably engageable with one another. The exemplary forward portion 16 and exemplary aft portion 18 are interconnected by a hinge 24 with a hinge axis 26. The exemplary forward portion 16 defines a forward mating face 28. The exemplary aft portion 18 defines an aft mating facing 30. The exemplary forward and aft mating faces 28 and 30 abut one another when the exemplary forward and aft portions 16 and 18 are pivoted together about the exemplary hinge axis 26 into an operating configuration. The operating configuration is shown in FIG. 1. The exemplary forward and aft mating faces 28 and 30 are offset from one another when the exemplary forward and aft portions 16 and 18 are pivoted apart about the exemplary hinge axis 26 into a loading configuration. The loading configuration is shown in FIG. 2. FIG. 2 shows the exemplary forward and aft mating faces 28 and 30 offset from one another.

The front and aft portions 16, 18 can be releasably connected with a lock 140. The lock 140 can include a hook 142 associated with the exemplary front portion 16 and a catch 144 associated with the exemplary aft portion 18. The catch 144 can be spring-biased into the locking position. A user can press down on the catch 144 to release the hook 142.

The exemplary body 12 is graspable and suspendable by human hand when in use. The exemplary body 12 is graspable by hand in that at least a portion of the exemplary body 12 can be surrounded by at least one hundred eighty degrees by a human hand. The body 12 can be grasped and lifted by a single human hand. The body 12 is suspendable by hand in that the body 12 is sufficiently light-weight so that the self-defense device 10 can be held in an elevated position during use, such as above the user's head or at the height of the user's head. Examples of other devices that are graspable and suspendable by human hand are flashlights.

Figure 8A:
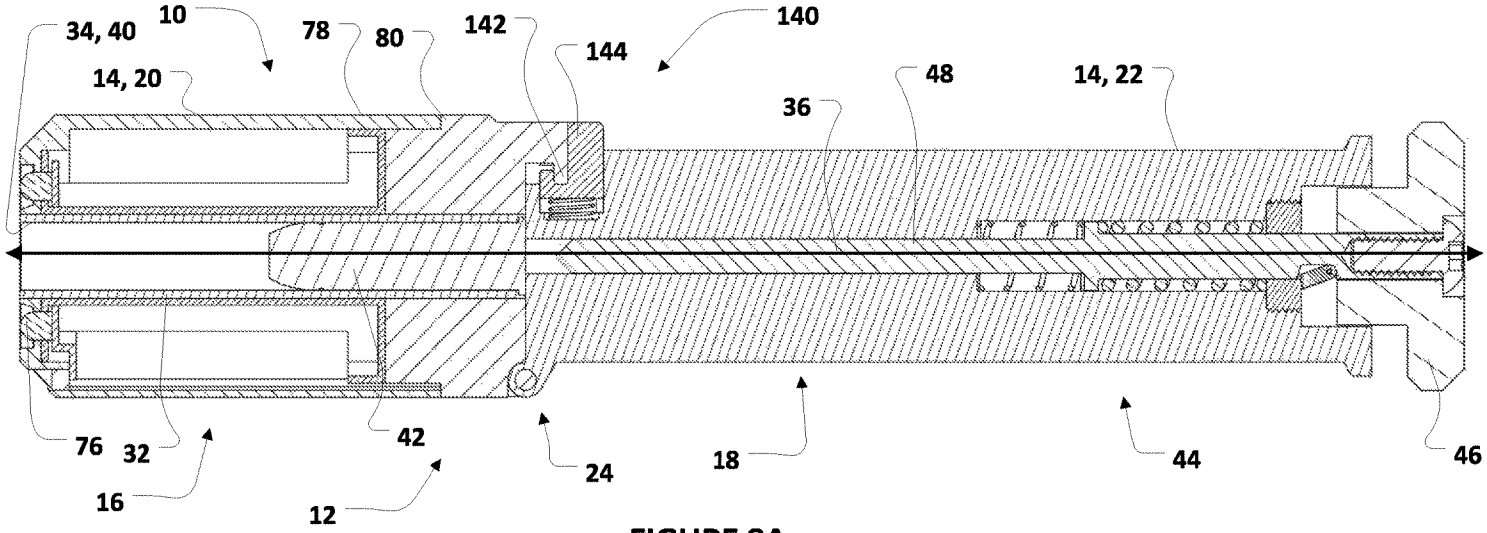
FIG. 8A is a cross-section of the self-defense device in a cocked configuration.
Figure 8B:
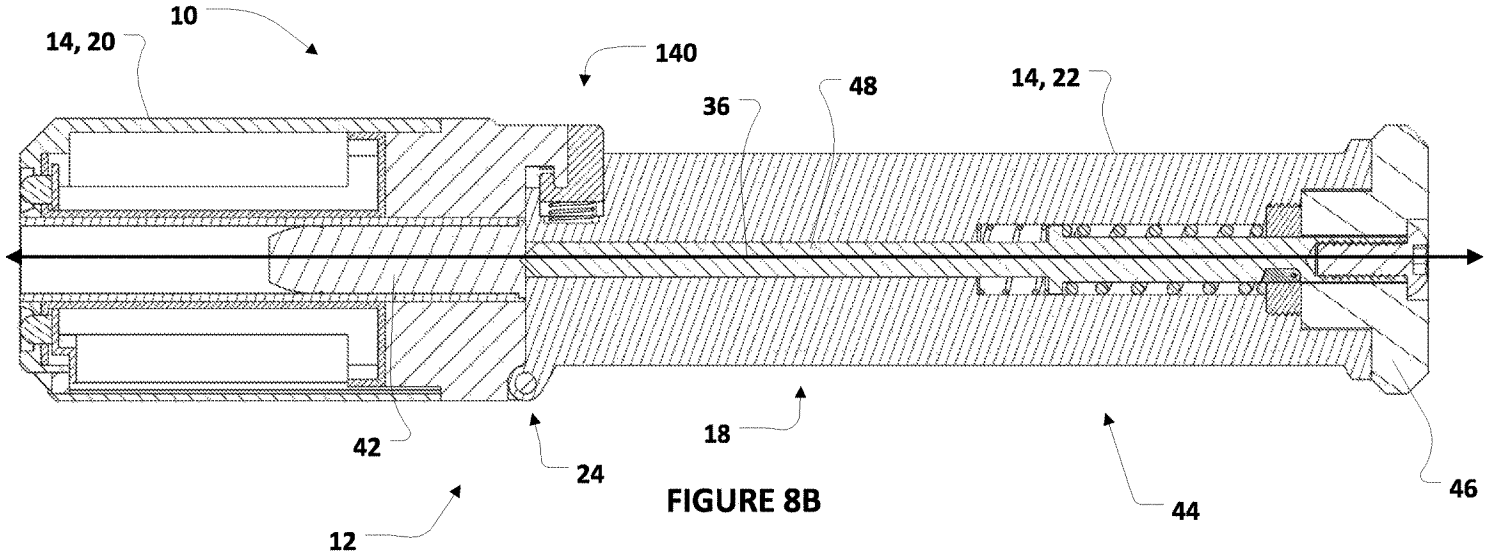
FIG. 8B is a cross-section of the self-defense device in a firing configuration.

The exemplary self-defense device 10 includes a gun barrel, such as exemplary gun barrel 32. The exemplary gun barrel 32 is partially housed in the body 12. The exemplary gun barrel 32 includes an interior surface 34 extending along a longitudinal axis 36 between an entry port 38 and an exit port 40. The exemplary exit port 40 is not enclosed by the exemplary body 12. A round of ammunition, such as referenced at 42, can be received in the exemplary gun barrel 32 and fired out of the exit port 40. FIG. 2 shows the round 42 during insertion in the gun barrel 32 and FIGS. 8A and 8B shows the round 42 seated for firing. Thus, the exemplary interior surface 34 of the exemplary gun barrel 32 and the exemplary outer surface 14 are respectively defined by separately-formed and subsequently joined structures. The exemplary gun barrel 32 is replaceably engageable with the exemplary body 12. In other words, the gun barrel 32 can be changed as often as desired or needed without having to replace the body 12.

The exemplary self-defense device 10 includes a trigger assembly, such as exemplary trigger assembly 44. The exemplary trigger assembly 44 includes a trigger 46 and a firing pin 48. The trigger assembly 44 can be at least partially housed in the body 12. The exemplary trigger assembly 44 is housed in the aft portion 18 proximate to the exemplary gun barrel 32. The exemplary firing pin 48 is selectively moveable to engage the round 42 positioned at the exemplary entry port 38.

Figure 9:
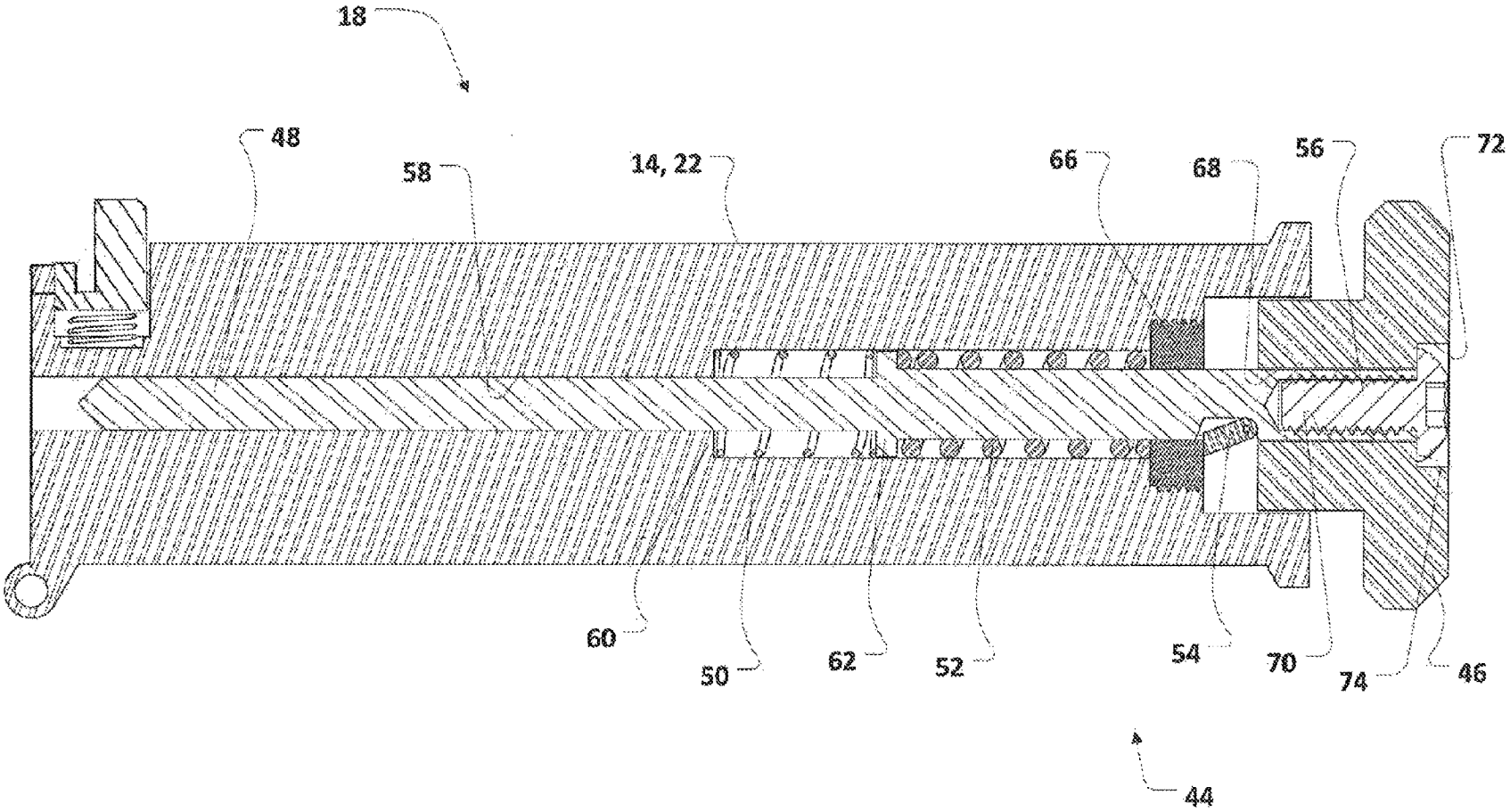
FIG. 9 is a cross-section of the aft portion of the self-defense device wherein a trigger assembly of the self-defense device is in the cocked configuration.
Figure 10:
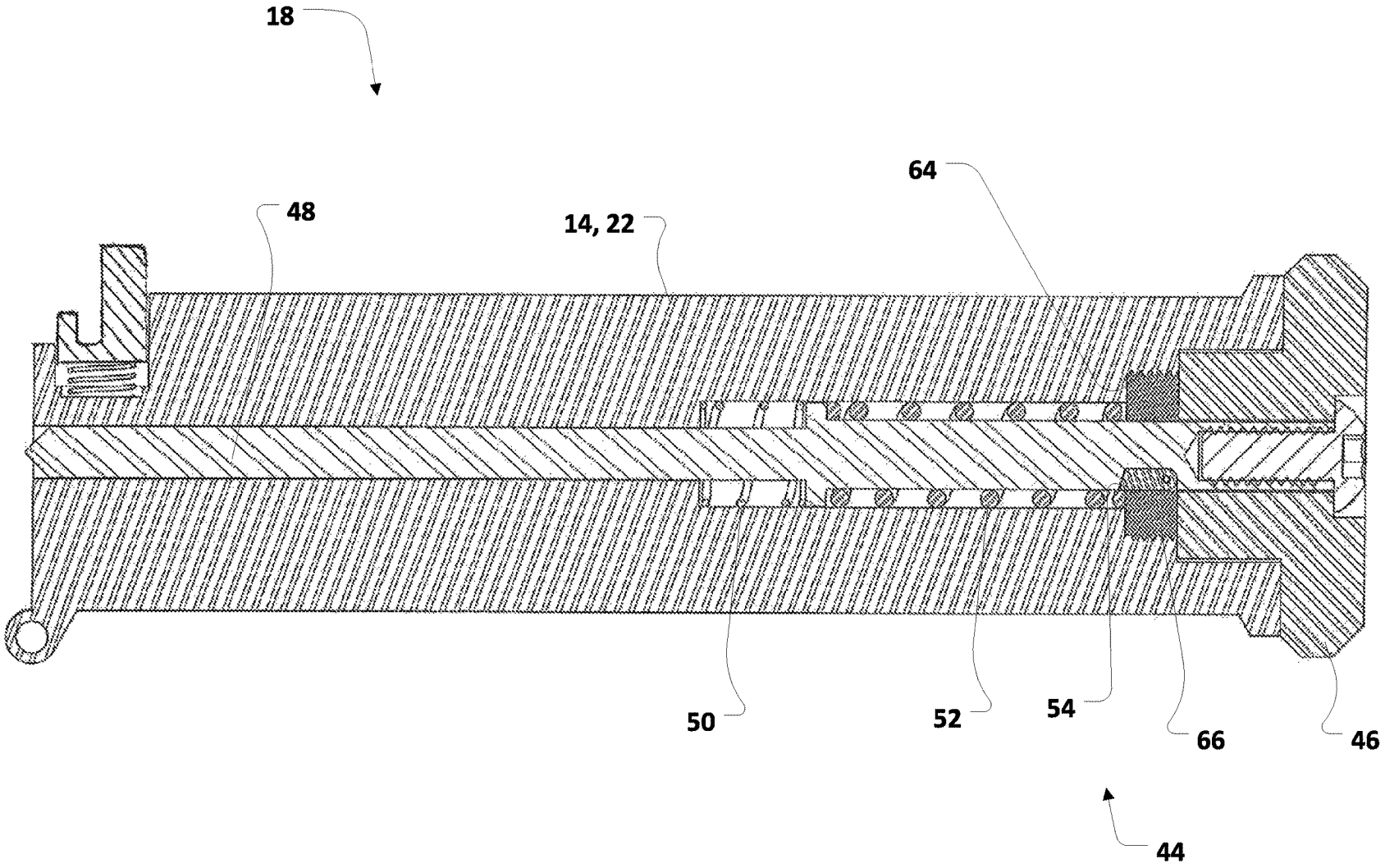
FIG. 10 is a cross-section of the aft portion of the self-defense device wherein the trigger assembly of the self-defense device is in the firing configuration.

Referring now to FIGS. 9 and 10, the exemplary trigger assembly 44 also includes a first spring 50, a second spring 52, a latch 54, a third spring, and a fastener 56. The exemplary firing pin 48 extends through an exemplary aperture 58 in the exemplary aft portion 18 of the exemplary body 12. The exemplary aperture 58 defines a shoulder 60. The exemplary first spring 50 is positioned between the shoulder 60 and a flange 62 defined by the firing pin 48. The exemplary first spring 50 biases the firing pin 48 toward a cocked position that is shown in FIG. 9 and away from a firing position that is shown in FIG. 10.

The exemplary aperture 58 also defines a threaded portion 64. A fastener 66 is threadingly engaged with the exemplary threaded portion 64. The exemplary second spring 52 is positioned between the flange 62 defined by the firing pin 48 and the fastener 66. The exemplary second spring 52 biases the firing pin 48 biases the firing pin 48 away from the cocked position that is shown in FIG. 9 and toward the firing position that is shown in FIG. 10. The exemplary second spring 52 exerts a great force on the firing pin 48 than the first spring 50 and can overcome the force generated by the first spring 50.

The exemplary 54 latch is mounted in a slot in the firing pin 48. The exemplary 54 latch can be recessed in the firing pin 48, as shown in FIG. 10, and thereby be flush with an outer surface of the firing pin 48. The exemplary 54 latch can also pivot away from being recessed in the firing pint 48, as shown in FIG. 9. The third spring can be mounted between the firing pin 48 and the latch 54 and bias the latch 54 away from being recessed in the firing pint 48. The third spring has not be shown due to its small size relative to the other structures.

The exemplary fastener 56 can interconnect the trigger 46 and the firing pin 48. The exemplary fastener 56 passes through an aperture 68 defined in the trigger 46. The exemplary fastener 56 is threadingly received in a threaded aperture 70 defined by the firing pin 48. A portion of the firing pin 48 also passes through the aperture 68. A head of the exemplary fastener 56 is positioned in an aperture 72 of the trigger 46.

The trigger assembly 44 can be cocked by the user by pulling the trigger 46 along the axis 36 and away from the body 12. A bottom surface 74 of the aperture 72 acts on the head of the fastener 56 to draw the firing pin 48 against the second spring 52. At some point during this movement, the latch 54 is released from being recessed in the firing pin 48. The latch 54 will then catch on the fastener 66 and prevent movement of the firing pin 48 toward the firing position. This is shown in FIG. 10.

When the self-defense device is fired, the user can press the trigger 46 toward the body 12. Initially, the trigger 46 will move relative to the fastener 56 and the firing pin 48. The surface 74 will separate from the head of the fastener 56. As the movement of the trigger 46 along the axis 36 continues, the aperture 68 will act as a cam and the latch 54 will act as a cam follower. The aperture 68 will force the latch 54 against the third spring and into being recessed in the firing pin 48. When the latch 54 is recessed and can clear the fastener 66, the firing pin 48 is released to the biasing force being applied by the second spring 52 and is driven into the round 42.

The exemplary self-defense device 10 includes at least one forward light, such as exemplary light 76. The exemplary light 76 is a light emitting diode (LED). In the exemplary embodiment, the self-defense device 10 includes a plurality of forward lights disposed proximate the exit 40 and disposed about (around) the axis 36. The exemplary light 76 is partially housed in the exemplary body 12. The light emitting portion of the forward light 76 is positioned on the outside surface 14 while circuitry and wiring associated with the forward light 76 can be positioned in the body 12. The exemplary at least one forward light 76 is positioned such that its field of emitted light projects along the exemplary longitudinal axis 36. The field of light of the exemplary forward light 76 is centered on an axis that is parallel to the axis 36.

The exemplary forward portion 16 is an assembly including a cup 78, a cap 80, and a carriage 82. The cup 78 can define an aperture 84 through which the exit port 40 communicates to allow the round 42 to exit the self-defense device 10. The cup 78 can define an aperture 86 through which the LED 76 protrudes. The exemplary cap 80 defines the exemplary face 28.

The carriage 82 can be received in the cup 78 and enclosed by the cup 78 and the cap 80. The carriage 82 can include an inner sleeve portion 90 that defines a central aperture 88 that receives the gun barrel 32. The carriage 82 can also include an aft ring 92 the fits closely into the cup 78 to keep the aperture 88 and aperture 34 coaxial. The carriage 82 can also include a forward ring 93 the fits closely into the cup 78 to ensure centering of the apertures 34, 88. Stanchions, such as stanchion 94, extend between and interconnect the inner sleeve potion 90 and the aft ring 92 and the forward ring 93.

The exemplary self-defense device 10 also includes a switch, such as exemplary switch 96. The exemplary switch 96 is configured to selectively activate and deactivate the LED 76. The exemplary switch 96 is at least partially housed in the aft portion 18 of the exemplary body 12. The exemplary switch 96 is exposed on the surface area 22 of the exemplary outer surface 14 of the exemplary body 12.

As shown in the Figures, in the exemplary embodiment of the present disclosure, the switch 96 and the trigger 46 are positioned proximate to one another so as to be concurrently engageable by different digits of a single human hand. By way of example and not limitation, the user can hold the device in her right hand. The user's thumb can be positioned on the trigger 46 and one or more of the user's fingers can be wrapped at least partially around the body 12 and positioned on the switch 96. Further, by way of example and not limitation, the user can approach an area to investigate and hold the device 10 above or at head level and press the switch 96 with one or more fingers to activate the LED 76 (or a plurality of LEDs). If the user encounters a threat, the user can then press the trigger 46 to fire the round 42 in the direction of the light that is emitted by the one or more LEDs 76. The gun barrel 32 and LEDs 76 are arranged such that the trajectory of the round 42 is substantially centered on the field of light emitted by the LEDs 76.

Thus, in the exemplary embodiment of the present disclosure, the longitudinal axis 36 intersects the exemplary trigger 46. The exemplary axis 36 passes through the exemplary trigger 46. The exemplary trigger 46 is centered on the exemplary axis 36. The exemplary trigger 46 moves rectilinearly along the axis 36. Conversely, the exemplary switch 96 is laterally spaced from the exemplary longitudinal axis 36. The exemplary switch 96 can move rectilinearly or pivotally to activate the LED 76. It is noted that in other embodiments, the longitudinal axis could intersect the switch and the trigger could be laterally spaced from the longitudinal axis.

Figure 11:
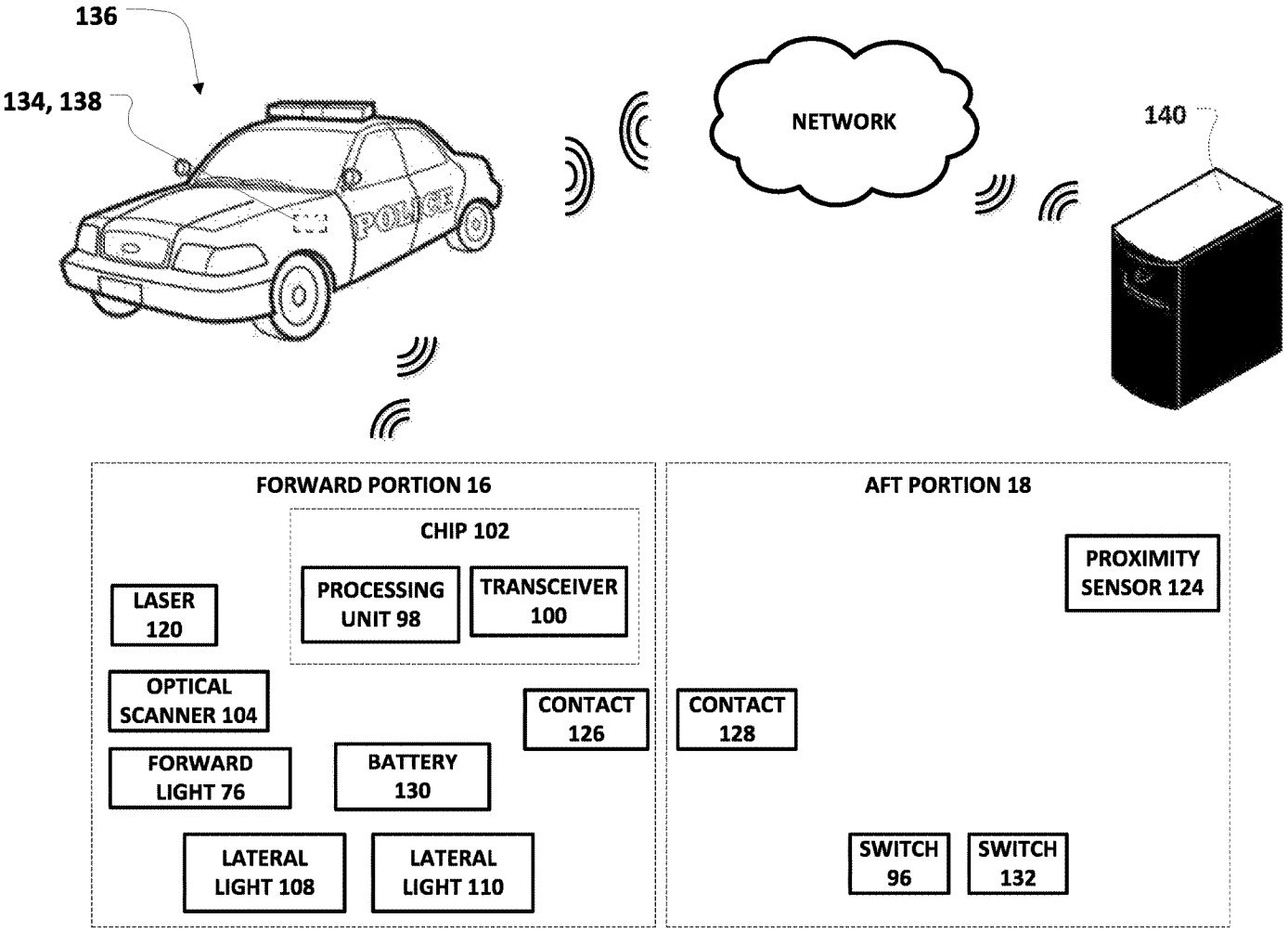
FIG. 11 is a functional block diagram of an exemplary electronic arrangement according to some implementations of the present disclosure.

FIG. 11 is a simplified schematic of an electrical system of the exemplary self-defense device 10 of the present disclosure. The exemplary self-defense device 10 includes a processing unit, such processing unit 98. The exemplary processing unit 98 is mounted in the exemplary body 12. The exemplary processing unit 98 is positioned on the carriage 82, between adjacent stanchions and between the aft and forward rings 92, 93.

The exemplary self-defense device 10 also includes transceiver, such as transceiver 100. The exemplary processing unit 98 communicates with the exemplary transceiver 100. The exemplary processing unit 98 is configured to communicate data wirelessly through the exemplary transceiver 100. The exemplary processing unit 98 and the exemplary transceiver 100 can be portions of a common integrated chip, such chip 102 shown in FIGS. 4 and 5. The chip 102 can be covered to prevent the user from being exposed to excessive heat, but can be generally exposed on the surface 14 so that the body 12 does not prevent the transmission of signals.

The exemplary self-defense device 10 also includes an optical scanner, such as exemplary optical scanner 104. The optical scanner 104 can be a bar code scanner, a QR code reader, or a camera. The exemplary optical scanner 104 is at least partially housed in the exemplary body 12. The exemplary optical scanner 104 is exposed on the exemplary outer surface 14 of the exemplary body 12 through an aperture 106 in the cup 78. The exemplary optical scanner 104 is configured to sense contents of an optical field that is forward of the exemplary exit port 40 and emit signals corresponding to the sensed optical field. For example, a driver's license can be positioned in the optical field and the exemplary optical scanner 104 can sense the indicia displayed on the license, convert the sensed indicia into electrical signals that correspond to the indicia, and transmit the electrical signals to the processing unit 98.

The device 10 can include a switch 132 to activate the optical scanner 104, positioned proximate to the switch 96 on the aft portion 18. The switch 132 is referenced only in FIG. 11. The user can press the switch 96 to turn the light 76 on and then press the switch 132 with the same finger used to press the switch 96. The switch 96 can be a spring-loaded on-off switch, so the light 76 can remain on while the switch 132 is pressed.

The exemplary self-defense device 10 also includes at least one lateral light, such as exemplary lights 108 and 110. The exemplary lights 108 and 110 are at least partially housed in the exemplary body 12 and exposed on the exemplary outer surface 14 of the exemplary body 12, through apertures 112, 114 in the cup 78. The exemplary lateral lights 108, 110 are positioned such that light emitted by the exemplary lateral lights 108, 110 are each centered on respective secondary axes that are perpendicular to the exemplary longitudinal axis 36. The field of light emitted by the exemplary lateral light 108 is centered along an axis 116. The field of light emitted by the exemplary lateral light 108 is centered along an axis 118. Substantially no light emitted by the lateral lights 108, 110 overlaps light emitted by the exemplary at least one forward light 76. The exemplary processing unit 98 is configured to selectively activate the exemplary lateral lights 108, 110. The exemplary lateral lights 108, 110 can be differently colored.

The exemplary self-defense device 10 also includes at least one laser, such as exemplary laser 120. The exemplary laser 120 is partially housed in the exemplary body 12 and exposed on the exemplary outer surface 14 of the exemplary body 12, through an aperture 122 in the cup 78. The exemplary laser 120 is positioned such that a beam emitted by the exemplary laser 120 projects parallel to the exemplary longitudinal axis 36.

The self-defense device 10 can include a sensor, such a proximity sensor 124 referenced only in FIG. 11. The exemplary proximity sensor 124 is positioned proximate to the trigger 46. The exemplary proximity sensor 124 is in electrical communication with the processing unit 98. When the user presses the trigger 46, the exemplary proximity sensor 124 can transmit a signal to the processing unit 98 and the processing unit 98 can control the laser 120 to activate. The exemplary proximity sensor 124 is positioned such that the exemplary laser 120 is activated and emits a laser beam in response to minimal movement of the trigger 46.

The exemplary self-defense device 10 also includes first and second electrical terminals, such as exemplary terminals 126, 128. The exemplary terminal 126 is mounted on face 28. The exemplary terminal 128 is mounted on face 30. The exemplary first and second electrical terminals 126, 128 are connected for electrical transmission when the exemplary forward and aft mating faces 28, 30 abut one another when the exemplary forward and aft portions 16, 18 are in the exemplary operating configuration (shown in FIG. 1). The exemplary first and second electrical terminals 126, 128 are unconnected when the exemplary forward and aft mating faces 28, 30 are offset from one another when the exemplary forward and aft portions 16, 18 are in the exemplary loading configuration (shown in FIG. 2). Electrical power and data signals can be transmitted across the exemplary first and second electrical terminals 126, 128.

The exemplary self-defense device 10 also includes a battery, such as exemplary battery 130. The exemplary battery 130 is housed in the exemplary forward portion 16. The exemplary battery 130 provides power to the electrical components of the device 10. The processing unit 98 controls the delivery of electrical power to the laser 120 and to the lateral lights 108, 110 in the exemplary embodiment of the present disclosure. The exemplary battery 130 communicates power to the forward light 76 when the exemplary switch 96 is in the "on" configuration. The exemplary battery 130 communicates power to the optical scanner 104 when the exemplary switch 132 is in the "on" configuration.

The exemplary self-defense device 10 can be part of self-defense system that also includes a computing device, having one or more processors and a second transceiver 138. In the exemplary embodiment, the computing device 134 is positioned in a police car 136 and powered by the electrical system of the car 136. The transceivers 100 and 138 can place the processing unit 98 and the computing device 134 in communication with one another. The exemplary processing unit 98 can receive the signals from the optical sensor 104. The signals can correspond to the indicia on a driver's license. The signals can therefore correspond to the identity of an individual.

The exemplary processing unit 98 can transfer the signals to the computing device 134. The computing device 134 can transfer the signals to another computing device, such as a server 140 over a network. The signals can be processed by the computing device 134 or the server 140 and compared to a database to determine the identity of the individual and the individual's criminal history and current status. The database can be a database of criminal offenders.

After the comparison of the signals against the database, if the individual is found to be a criminal offender and/or has a pending warrant, the computing device 134 or the server 140 can transmit a warning signal back to the transceiver 100 and thus back to the processing unit 98. In response to receiving the warning signal, the processing unit 98 can control one or both of the lateral lights 108, 110 to activate. For example, one of the lateral lights 108, 110 can be yellow and the other red. The red lateral light can be activated if the individual has a pending warrant. The yellow lateral light can be activated if the individual has prior criminal convictions.

In one or more embodiments of the present disclosure, a vehicle shut-off device can be positioned in the car 136 and be at least partially under the control of the computing device 134. In response to a warning signal, the exemplary computing device 134 is further configured to retrieve a vehicle shut-off code and transmit the vehicle shut-off code to disengage the vehicle of the individual. In one or more embodiments of the present disclosure, in response to a warning signal, the exemplary processing unit 98 is further configured activate the laser 120.

Figure 12:
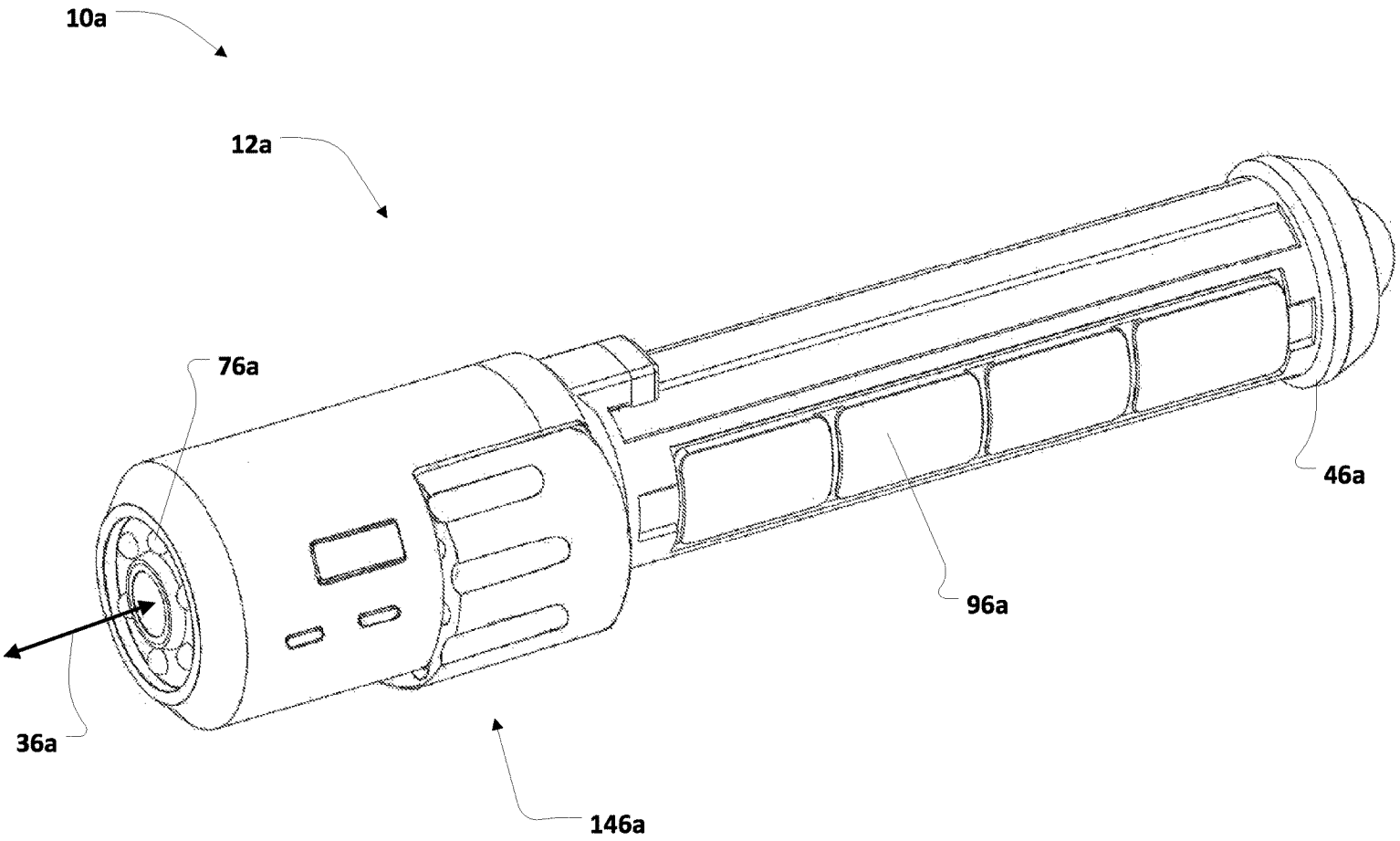
FIG. 12 is a side view of a second embodiment of the present disclosure.

A second embodiment of the present disclosure is shown in FIG. 12. A self-defense 10*a* device can include a body 12*a*, a gun barrel, a trigger assembly with a trigger 46*a*, at least one forward light 76*a*, and a switch 96*a*. The body 12*a* can be graspable and suspendable by human hand. The gun barrel can be at least partially housed in the body 12*a* and can extend along a longitudinal axis 36*a* between an entry port and an exit port. The exit port is not enclosed by the body 12*a*. The trigger assembly can also include a firing pin. The trigger assembly can be at least partially housed in the body 12*a* proximate to the gun barrel such that the firing pin is selectively moveable to engage a round positioned at the entry port. The at least one forward light 76*a* can be at least partially housed in the body 12*a* and exposed on an outer surface of the body 12*a*. The at least one forward light 76*a* is positioned such that light emitted by the at least one forward light 76*a* projects along the longitudinal axis 36*a*. The switch 96*a* can be configured to selectively activate and deactivate the at least one forward light 76*a*. The switch 96*a* is at least partially housed in the body 12*a* and exposed on the outer surface of the body 12*a*. The switch 96*a* and the trigger 46*a* are positioned close to one another so as to be concurrently engageable by a single human hand.

The self-defense device 10*a* includes a cylinder 146*a* that replaceably engageable with the exemplary body 12*a*. The exemplary gun barrel is defined by the exemplary cylinder 146*a*. The exemplary cylinder 146*a* also defines a second gun barrel.

As set forth above, the optical scanner can be a camera. A camera would be useful to the user when investigating a crime scene. The camera could function like a cellphone camera, such as allowing the user to take pictures, videos, scans of hand-prints, eye-scans, and also photo-zoom for capturing pictures of license plate numbers from a distance. The visual data captured by a camera can be communicated to the computing device 134 and stored in the server 140.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A self-defense device comprising:

a body being graspable and suspendable by human hand when in use;

a gun barrel at least partially housed in said body and including an interior surface extending along a longitudinal axis between an entry port and an exit port, wherein said exit port is not enclosed by said body;

a trigger assembly with a trigger and a firing pin and at least partially housed in said body proximate to said gun barrel such that said firing pin is selectively moveable to engage a round positioned at said entry port;

at least one forward light at least partially housed in said body and exposed on an outer surface of said body, wherein said at least one forward light is positioned such that light emitted by said at least one forward light projects along said longitudinal axis;

a switch configured to selectively activate and deactivate said at least one forward light, said switch at least partially housed in said body and exposed on said outer surface of said body, wherein said switch and said trigger are positioned proximate to one another so as to be concurrently engageable by different digits of a single human hand; and wherein said longitudinal axis intersects said trigger and said switch is laterally spaced from said longitudinal axis.

2. The self-defense device of claim 1 wherein said outer surface of said body and said interior surface of said gun barrel are respectively defined by separately-formed and subsequently joined structures.

3. The self-defense device of claim 1 further comprising:

an optical scanner at least partially housed in said body and exposed on said outer surface of said body, said optical scanner configured to sense contents of an optical field forward of said exit port and emit first signals corresponding to the sensed optical field.

4. The self-defense device of claim 3 further comprising:

a first transceiver at least partially housed in said body and at least partially exposed on said outer surface of said body, said first transceiver configured to receive said first signals corresponding to the sensed optical field from said optical scanner and emit said first signals wirelessly.

5. The self-defense device of claim 1 further comprising:

at least one laser at least partially housed in said body and exposed on said outer surface of said body, wherein said at least one laser is positioned such that a beam emitted by said at least one laser projects parallel to said longitudinal axis.

6. The self-defense device of claim 1 wherein said gun barrel is further defined as being replaceably engageable with said body.

7. The self-defense device of claim 1 further comprising:

a cylinder replaceably engageable with said body, wherein said gun barrel is defined by said cylinder and said cylinder also defines a second gun barrel.

8. The self-defense device of claim 1 wherein said body further comprises:

forward and aft portions releasibly engageable with one another.

9. The self-defense device of claim 8 wherein said forward and aft portions are interconnected by a hinge with a hinge axis, said forward portion defining a forward mating face and said aft portion defining an aft mating facing, said forward and aft mating faces abutting one another when said forward and aft portions are pivoted together about said hinge axis into an operating configuration, and said forward and aft mating faces offset from one another when said forward and aft portions are pivoted apart about said hinge axis into a loading configuration.

10. The self-defense device of claim 9 further comprises:

first and second electrical terminals, wherein said first and second electrical terminals are connected for electrical transmission when said forward and aft mating faces abut one another when said forward and aft portions are in said operating configuration and unconnected when said forward and aft mating faces are offset from one another when said forward and aft portions are in said loading configuration.

11. The self-defense device of claim 10 further comprising:

a battery housed in said forward portion, wherein said at least one forward light is mounted in said forward portion and said switch is mounted in said aft portion.

12. The self-defense device of claim 1 further comprising:

a battery at least partially housed in said body and communicating with said at least one forward light through said switch.

13. A self-defense device comprising:

a body being graspable and suspendable by human hand when in use;

a gun barrel at least partially housed in said body and including an interior surface extending along a longitudinal axis between an entry port and an exit port, wherein said exit port is not enclosed by said body;

a trigger assembly with a trigger and a firing pin and at least partially housed in said body proximate to said gun barrel such that said firing pin is selectively moveable to engage a round positioned at said entry port;

at least one forward light at least partially housed in said body and exposed on an outer surface of said body, wherein said at least one forward light is positioned such that light emitted by said at least one forward light projects along said longitudinal axis;

a switch configured to selectively activate and deactivate said at least one forward light, said switch at least partially housed in said body and exposed on said outer surface of said body, wherein said switch and said trigger are positioned proximate to one another so as to be concurrently engageable by different digits of a single human hand;

an optical scanner at least partially housed in said body and exposed on said outer surface of said body, said optical scanner configured to sense contents of an optical field forward of said exit port and emit first signals corresponding to the sensed optical field;

a first transceiver at least partially housed in said body and at least partially exposed on said outer surface of said body, said first transceiver configured to receive said first signals corresponding to the sensed optical field from said optical scanner and emit said first signals wirelessly; and a computing device, having one or more processors and a second transceiver, configured to receive said first signals from said first transceiver, compare said first signals to a database of criminal offenders, and emit a warning signal wirelessly.

14. The self-defense device of claim 13 wherein said first transceiver is further defined as configured to receive said warning signal from said second transceiver.

15. The self-defense device of claim 14 further comprising:

a processing unit mounted in said body and communicating with said first transceiver, said processing unit configured to receive said warning signal from said computing device by way of said first transceiver and said second transceiver.

16. The self-defense device of claim 15 further comprising:

at least one lateral light at least partially housed in said body and exposed on said outer surface of said body, wherein said at least one lateral light is positioned such that light emitted by said at least one lateral light is centered on a secondary axis that is perpendicular to said longitudinal axis, wherein said processing unit is further configured to selectively activate said at least one lateral light in response to said warning signal.

17. The self-defense device of claim 16 wherein said at least one lateral light is further defined as a plurality of lights of different colors.

18. The self-defense device of claim 15 wherein said computing device is further configured to retrieve a vehicle shut-off code and transmit the vehicle shut-off code.

* * * * *